US006766122B2

(12) United States Patent
Phillips et al.

(10) Patent No.: US 6,766,122 B2
(45) Date of Patent: Jul. 20, 2004

(54) SYSTEM AND METHODS FOR CALIBRATING A PRINTING PROCESS

(75) Inventors: Quintin T. Phillips, Boise, ID (US); David A. Johnson, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/281,613

(22) Filed: Oct. 28, 2002

(65) Prior Publication Data

US 2004/0081475 A1 Apr. 29, 2004

(51) Int. Cl.[7] ..... G03G 15/00; G03G 21/12; G03G 15/16

(52) U.S. Cl. ..... 399/49; 399/35; 399/66; 399/71

(58) Field of Search ..... 399/9, 15, 27, 399/34, 35, 49, 53, 66, 71, 72, 301

(56) References Cited

U.S. PATENT DOCUMENTS

| | | | | | |
|---|---|---|---|---|---|
| 4,967,238 | A | * | 10/1990 | Bares et al. | 399/34 |
| 5,132,730 | A | * | 7/1992 | Hurwitch et al. | 399/72 X |
| 5,294,959 | A | * | 3/1994 | Nagao et al. | 399/66 X |
| 5,296,903 | A | * | 3/1994 | Suzuki et al. | 399/66 |
| 5,333,037 | A | * | 7/1994 | Inoue et al. | 399/49 |
| 5,740,495 | A | * | 4/1998 | Maher et al. | 399/71 |
| 5,918,085 | A | * | 6/1999 | Rollins et al. | 399/27 |
| 5,978,615 | A | * | 11/1999 | Tanaka et al. | 399/49 |
| 6,061,533 | A | * | 5/2000 | Kajiwara | 399/49 |

* cited by examiner

*Primary Examiner*—Sandra L. Brase

(57) ABSTRACT

The system and methods described herein relate to calibrating an electrophotographic (EP) printing process. Calibration patches are monitored before and after transfer and cleaning functions to provide information useful in adjusting an EP process to improve overall print quality. Benefits of the described system and methods include the use of pre-existing hardware currently in use on most EP printing devices to provide improved calibration information that permits accurate control over an EP printing process.

23 Claims, 7 Drawing Sheets

SYSTEM AND METHODS FOR CALIBRATING A PRINTING PROCESS

TECHNICAL FIELD

The present disclosure relates to calibrating a printing process, and more particularly, to calibrating a printing process based on multiple interrogations of a calibration patch occurring between various printing functions.

BACKGROUND

Current electrophotographic (EP) printing processes require calibration in order to maintain acceptable print quality. An EP process generally includes an imaging process and an image transfer process. The imaging process includes placing an image on an intermediate transfer element (e.g., a photoconductor drum or a transfer belt) and developing the image with a marking agent, such as a dry toner. The transfer process generally includes transferring and fusing the image to a print medium such as paper or a transparency. Calibrating an EP printing process helps account for process variations caused by problems such as the deterioration of a photoconductor drum or transfer belt within the EP printing device.

Conventional EP printing devices calibrate the printing process by comparing a measured amount of marking agent from a calibration patch with an expected amount. A calibration patch is typically a square shaped area filled to a certain density or percentage level with a marking agent. The patch is formed or developed on a transfer element (e.g., a photoconductor drum) during an imaging process. A sensor measures the amount of marking agent present on the patch. The measured amount of marking agent is then compared to a known parameter to determine if the calibration patch actually contains the expected density or percentage fill of marking agent.

If the measured amount of marking agent is more or less than expected, the printing process is adjusted to provide an increase or decrease in the amount of marking agent used during the imaging process to compensate for the difference. Thus, the calibration procedure helps to maintain print quality by monitoring the amount of marking agent being used in the imaging portion of the EP printing process.

However, the calibration procedure used in conventional EP printing devices has some disadvantages. One disadvantage is that the current calibration procedure is premised on the assumption that all the marking agent developed on a transfer element (e.g., a photoconductor drum) during an imaging process actually transfers to the print medium during a transfer process. In the described calibration procedure, the density of the calibration patch is measured when the patch is on the transfer element. The patch does not transfer to a print medium, and there is no determination made as to the amount of marking agent that ultimately transfers to the print medium. Thus, the calibration procedure only measures the density or amount of marking agent that is developed on the transfer element. It does not measure the amount of marking agent that actually ends up on the print medium.

The calibration procedure is therefore inaccurate to the extent that the transfer process is imperfect. That is, although the calibration procedure accounts for anomalies up through the imaging process by comparing actual and expected marking agent densities at the transfer element, it does not account for anomalies that may exist in the image transfer process. Current calibration procedures provide no accounting of how much marking agent actually ends up on a print medium. Thus, the overall goal of maintaining print quality may be frustrated by an imprecise image transfer process despite the presence of a properly functioning calibration procedure.

Other disadvantages with current calibration procedures relate to the limited information they provide. For example, the calibration patch is a one-time use item. Once the patch is developed to and measured on the transfer element, the marking agent making up the patch is scraped off the transfer element into a waste hopper by a cleaning blade. In addition to not providing any information about how much marking agent actually transfers to a print medium, current calibration procedures do not provide any information regarding how much marking agent ends up in the waste hopper as waste.

Accordingly, the need exists for a way to calibrate an EP printing process that accounts for the amount of marking agent that actually reaches a print medium and that provides additional beneficial information about the process not currently provided by conventional calibration procedures.

SUMMARY

A system and methods gather calibration information both before and after implementing various printing functions in an electrophotographic (EP) printing process. The printing functions are applied to a calibration patch developed on a transfer element within an EP printing device.

In one embodiment, a calibration patch is formed on an intermediate transfer element and measured to determine the density or percentage fill of the marking agent (e.g., dry toner) that makes up the patch. The calibration patch is then transferred to a print medium, and the area of the transfer element on which the patch was formed is measured again. A transferred amount of marking agent is then calculated based on the amounts of marking agent measured both before and after the transfer step.

In another embodiment, after the area of the transfer element on which the patch was formed is measured for the second time, the area is scraped with a cleaning blade to remove marking agent into a waste hopper. The area of the transfer element on which the patch was formed is then measured again. A waste amount of marking agent is then calculated based on the amounts of marking agent measured both before and after the scraping step.

BRIEF DESCRIPTION OF THE DRAWINGS

The same reference numbers are used throughout the drawings to reference like components and features.

DETAILED DESCRIPTION

The system and methods described herein relate to calibrating an electrophotographic (EP) printing process. Calibration patches are monitored before and after transfer and cleaning functions to provide information useful in adjusting an EP process to improve overall print quality. Benefits of the described system and methods include the use of pre-existing hardware currently in use on most EP printing devices to provide improved calibration information that permits accurate control over an EP printing process.

Exemplary System Environment for Calibrating a Printing Process

Figure 1:
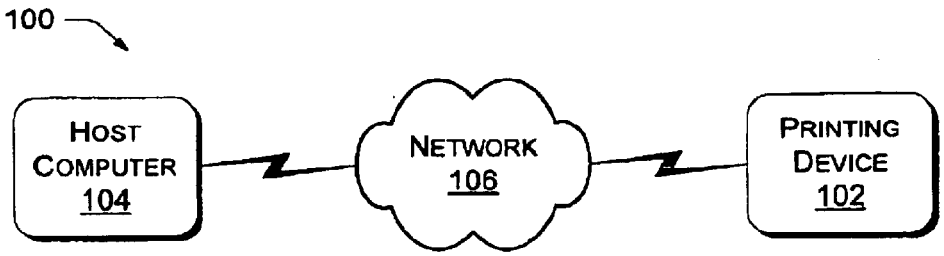
FIG. 1 illustrates a system environment that is suitable for calibrating a printing process.

FIG. 1 illustrates an exemplary system environment that is suitable for calibrating a printing process. The exemplary system environment 100 of FIG. 1 includes printing device 102 operatively coupled to a host computer 104 through a direct or network connection 106. The direct or network connection 106 can include, for example, a printer cable, a LAN (local area networks), a WAN (wide area networks), an intranet, the Internet, or any other suitable communication link.

This disclosure is applicable to various types of printing devices 102 capable of implementing an electrophotographic (EP) printing process. This generally includes printing devices 102 that employ the use of a dry marking agent (e.g., dry toner) transfer mechanism that has an intermediate image transfer region such as a photoconductor drum or transfer belt. Therefore, printing device 102 generally includes devices such as laser-based printers or LED-based (i.e., light emitting diode based) printers. In addition, printing device 102 can include various multi-function peripheral (MFP) devices that combine an EP printing process with other functions such as faxing, scanning, copying and the like.

Host computer 104 can be implemented as a variety of general purpose computing devices including, for example, a personal computer (PC), a server, a Web server, and other devices configured to communicate with printing device 102. Host computer 104 typically provides a user with the ability to manipulate or otherwise prepare in electronic form, an image or document to be rendered as an image that is printed or otherwise formed onto a print medium by printing device 102 after transmission over network 106. In general, host computer 104 outputs host data to printing device 102 in a driver format suitable for the device 102, such as PCL or PostScript. Printing device 102 converts the host data and outputs it onto an appropriate recording media, such as paper or transparencies.

Exemplary System Embodiment for Calibrating a Printing Process

Figure 2:
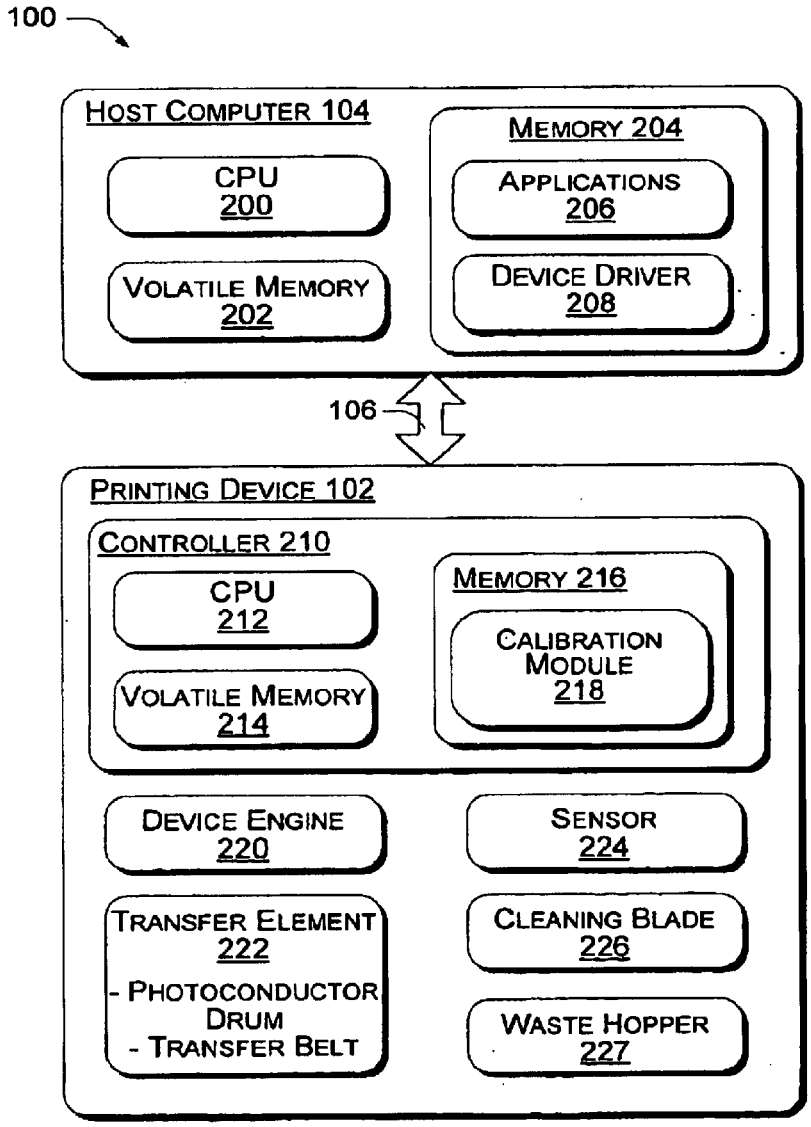
FIG. 2 is a block diagram illustrating in greater detail, an exemplary embodiment of a host computer and printing device such as those shown in FIG. 1.

FIG. 2 illustrates an exemplary embodiment of the system 100 in greater detail. Host computer 104 includes a processor 200, a volatile memory 202 (i.e., RAM), and a non-volatile memory 204 (e.g., ROM, hard disk, floppy disk, CD-ROM, etc.). Nonvolatile memory 204 generally provides storage of computer readable instructions, data structures, program modules and other data for host computer 104. Host computer 104 may implement various application programs 206 stored in memory 204 and executed on processor 200 that create a document or image (e.g., text and graphics) on a computer screen that is transferred to printing device 102 for creating a hard copy of the document/image. Such applications 206 might include software programs implementing word processors, illustrators, computer-aided design tools and the like.

Host computer 104 may also implement one or more software-based device drivers such as printing device driver 208 that are stored in non-volatile memory 204 and executed on processor 200. Device drivers might also be implemented on the specific devices they are "driving". In general, a device driver such as driver 208 formats document information into page description language (PDL) such as PostScript or Printer Control Language (PCL) or another appropriate format which it outputs to printing device 102.

Printing device 102 has a controller 210 that processes data from host computer 104. The controller 210 typically includes a data processing unit or CPU 212, a volatile memory 214 (i.e., RAM), and a nonvolatile memory 216. Nonvolatile memory 216 can include various computer storage media such as ROM, flash memory, a hard disk, a removable floppy disk, a removable optical disk and the like. Nonvolatile memory 216 generally provides storage of computer readable instructions, data structures, program modules and other data for printing device 102.

In the exemplary embodiment of FIG. 2, printing device 102 also includes a calibration module 218 stored in memory 216. In general, calibration module 218 executes on processor 212 to perform a calibration procedure through the management of printing device engine 220, intermediate transfer element 222 (e.g., a photoconductor drum or intermediate transfer belt), sensor 224 and cleaning blade 226. An exemplary calibration procedure is discussed more specifically herein below with respect to FIGS. 5, 6, and 7.

Exemplary EP Printing Process for Calibration

Figure 3:
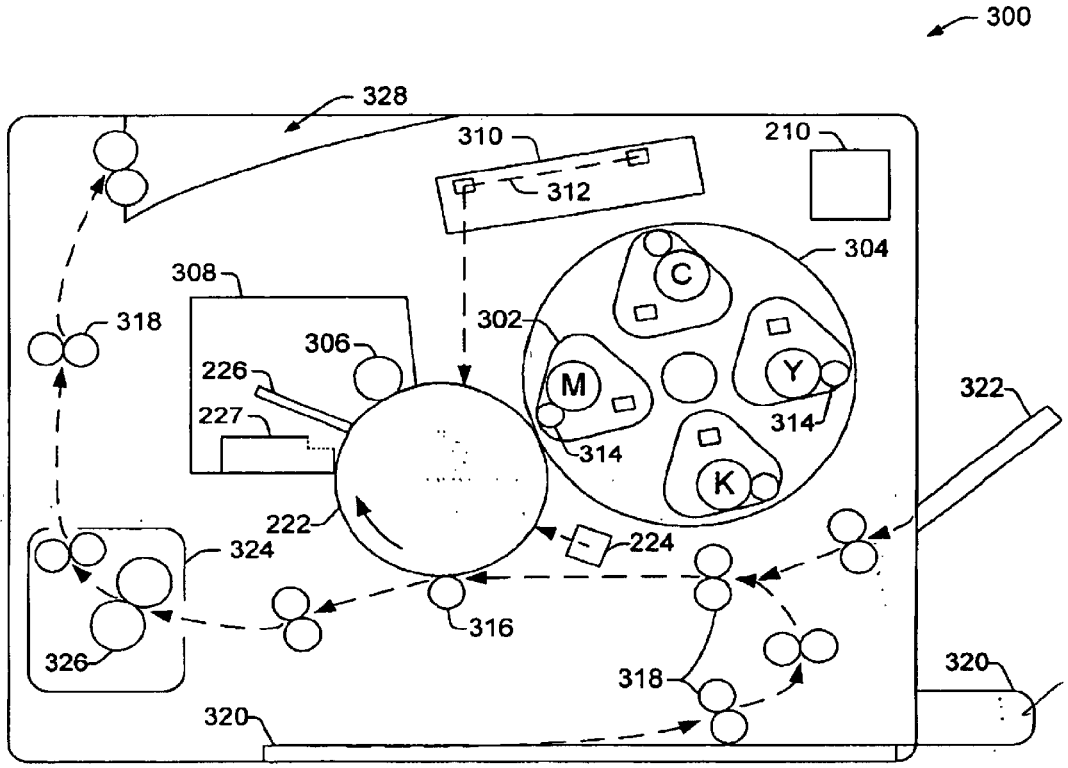
FIG. 3 illustrates a printing device that implements an electrophotographic printing process suitable for calibration.

FIG. 3 represents a color laser printer 300 as an example printing device 102 that may be used in the system 100 of FIGS. 1 and 2. An example of an EP printing process will now be described with respect to color laser printer 300 for the purpose of illustrating a context in which a calibration procedure might be implemented.

An EP printing process generally includes an imaging process and an imaging transfer process. A typical color laser printer 300 implementing an EP process produces an image using various colored toners. During an imaging process, a four color image is built sequentially onto an intermediate transfer element 222 such as photoconductor drum or an intermediate transfer belt before it is finally transferred to the print medium (e.g., paper, transparency) in one pass. The ultimate application of the toners to the print medium is controlled by an imaging transfer process.

Color printer 300 houses four toner cartridges 302 in a rotating carousel 304 that is operational with photoconductor drum 222. Toner cartridges 302 contain the four main toner colors cyan (C), magenta (M), yellow (Y), and black (K). Although the toner cartridges 302 are illustrated as separate devices inserted into rotating carousel 304, they may additionally be implemented as a single, all-in-one color cartridge that includes the four toner colors. For example, the rotating carousel 304 may represent a single, all-in-one color cartridge, while toner cartridges 302 represent separate housings within the all-in-one cartridge for accommodating the four color toners. In addition, photoconductor drum 222 may be implemented as one or more photoconductor drums. For example, there may be four photoconductor drums 222, one to accommodate the transfer of each color toner.

To begin the imaging process, a primary charge roller (PCR) 306 within the photoconductor drum assembly 308 applies an electrostatic charge to the photoconductor drum 222. As the photoconductor drum 222 rotates, a laser assembly 310 writes the latent image for the first color onto the drum 222 with laser 312. The toner carousel 304 then puts the first color toner cartridge 302 into position for operation with the photoconductor drum 222. Within toner cartridge 302, an agitator (not shown) guides toner to a developer roller 314. As the developer roller 314 and photoconductor drum 222 rotate, the toner is developed to the latent image electrostatically formed on the photoconductor drum 222.

Each color image is thus developed one at a time on the photoconductor drum 222 through the imaging process. Once the four-color image has been built on the photoconductor drum 222, it is transferred in an image transfer process to a print medium such as paper or a transparency. In the image transfer process, the secondary transfer roller 316 is activated to attract the image away from the drum 222 and onto the paper in one pass of the drum 222 over the paper. The paper is guided by guide rollers 318 from a paper tray 320 or external source 322 past the drum 222 and then through the fuser assembly 324. The fuser assembly 324 includes two hot rubber fuser rollers 326 that melt the toner, bonding it to the paper. From the fuser assembly 324, the paper then exits the printer 300 into the output tray 328.

Exemplary Calibration Procedure of an EP Printing Process

An exemplary calibration procedure for an EP printing process will now be described with respect to FIGS. 5, 6, and 7. First however, for purposes of comparison, a calibration procedure as implemented in the prior art will be described with respect to FIG. 4.

Figure 4:
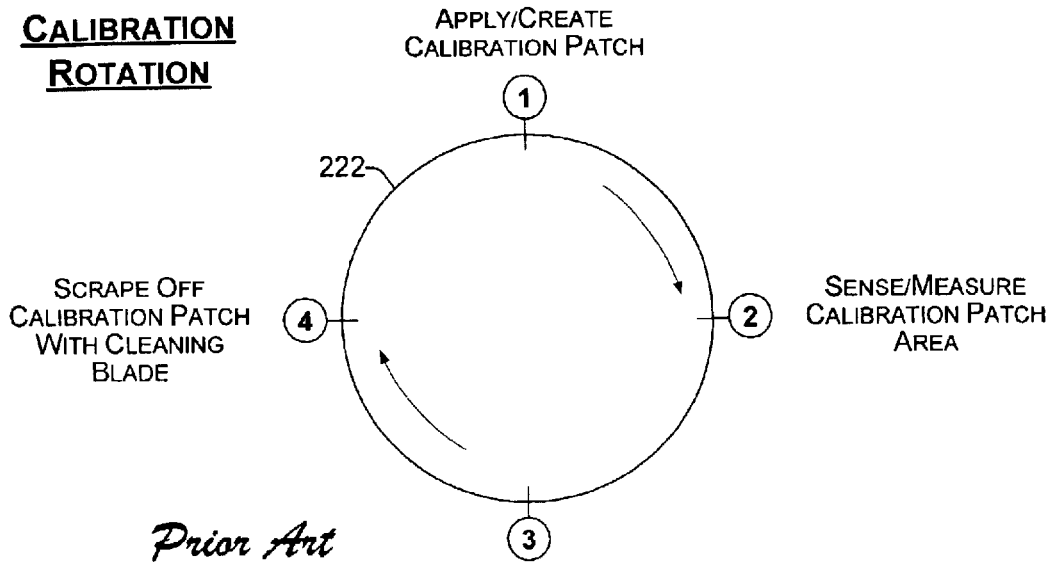
FIG. 4 illustrates an intermediate transfer element rotating through a calibration process as implemented in the prior art.

FIG. 4 illustrates an example of a calibration procedure as might be implemented in the prior art. Steps in the procedure are generally performed during a single rotation of an intermediate transfer element 222 such as photoconductor drum 222. During an imaging process at a first station, a calibration patch or pattern is developed on a photoconductor drum 222. A calibration patch is typically a square shaped area filled to a certain density or percentage level with a marking agent (e.g., dry toner). As the drum 222 rotates past a second station, a sensor measures the amount of marking agent present in the area of the calibration patch. The amount of marking agent is then compared to a known parameter and the EP process may be adjusted to increase or decrease the amount of marking agent applied to the photoconductor drum 222 during the subsequent imaging of print jobs. As the drum 222 rotates past a fourth station, a cleaning blade 226 cleans the marking agent off the calibration patch area on the drum 222. Calibration patches as used in the prior art are therefore single-use items that provide information relevant to only the imaging portion of the EP printing process.

Figure 5:
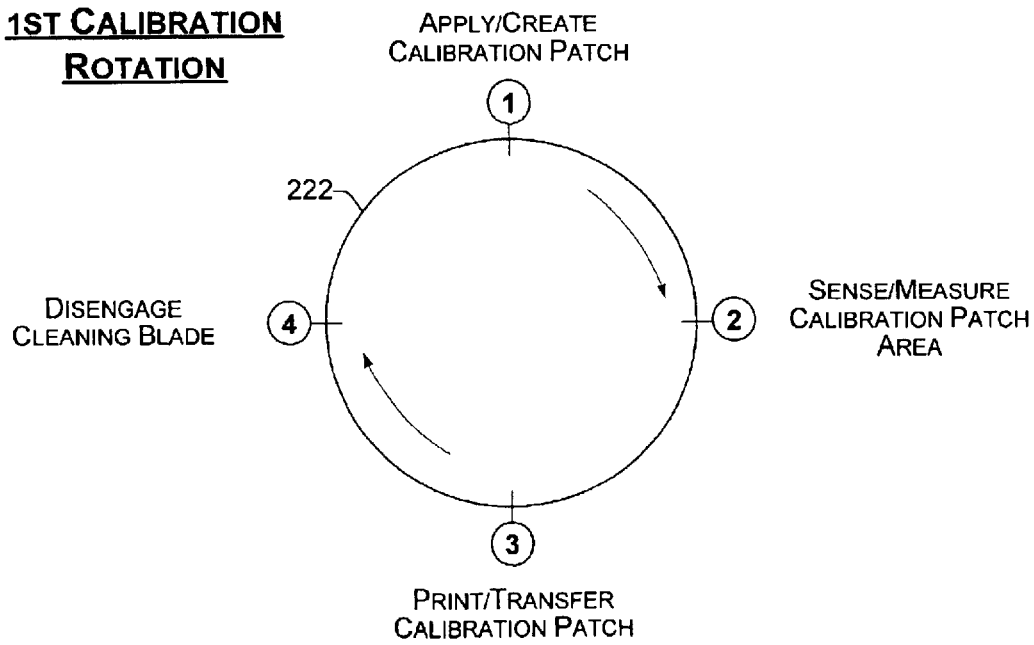
FIG. 5 illustrates an intermediate transfer element rotating through a first calibration rotation in a calibration process.
Figure 6:
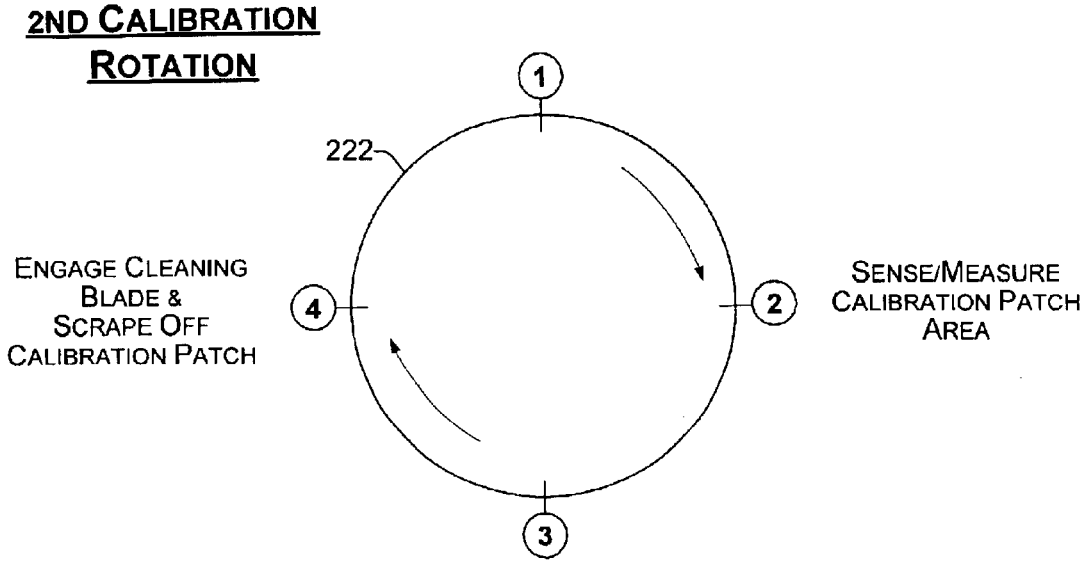
FIG. 6 illustrates an intermediate transfer element rotating through a second calibration rotation in a calibration process.
Figure 7:
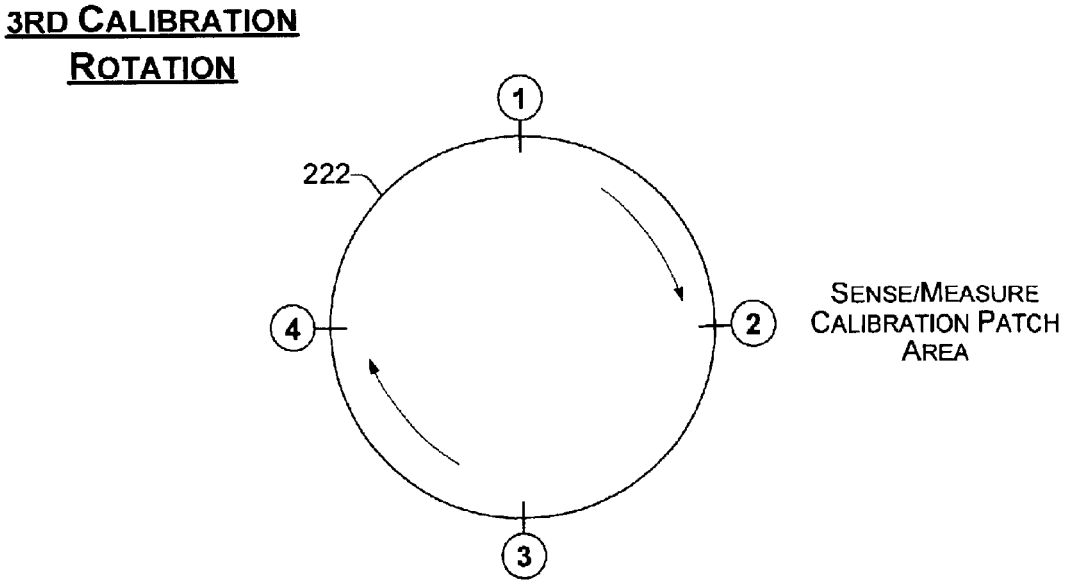
FIG. 7 illustrates an intermediate transfer element rotating through a third calibration rotation in a calibration process.

By contrast, an exemplary calibration procedure as shown in FIGS. 5, 6, and 7 relates to the exemplary system 100 of FIGS. 1 and 2, and provides information relevant to various steps in the EP printing process. FIG. 5 illustrates an intermediate transfer element 222 such as photoconductor drum 222 rotating through a first calibration rotation in such a calibration procedure. At a first station, the imaging process develops a calibration patch or pattern to the photoconductor drum 222. As the drum 222 rotates past a second station, a sensor 224 measures the amount of marking agent (e.g., dry toner) present in the area of the calibration patch.

The sensor 224 typically includes a light source and a light detector. The light source shines light on the calibration patch at a certain angle, and the light detector receives the light reflecting off the patch at an opposite angle. The reflectivity of the calibration patch is thus measured by sensor 224. The reflectivity value can be correlated through various means (e.g., a lookup table) to a density value for the calibration patch, thus indicating the percentage of marking agent present on the patch.

As the photoconductor drum 222 rotates through a third station, the transfer process transfers (i.e., prints) the calibration patch onto a print medium. At a fourth station, the cleaning blade 226 is disengaged. The cleaning blade 226 is normally engaged during an EP printing process in order to scrape remaining marking agent (e.g., dry toner) off the photoconductor drum 222 into a waste hopper 227. By disengaging the cleaning blade 226, the calibration patch area can be measured a second time during a second drum 222 rotation (i.e., see FIG. 6) to determine how much marking agent did not transfer during the transfer process.

FIG. 6 illustrates the photoconductor drum 222 rotating through a second calibration rotation in a calibration process. As the drum 222 rotates past the second station, the sensor 224 again measures the amount of marking agent present in the area of the calibration patch. As indicated above, any marking agent remaining on the drum 222 will be an amount that did not transfer to the print medium during the transfer process. As the drum 222 rotates past a fourth station in the second calibration rotation of FIG. 6, the cleaning blade 226 is engaged in order to clean the marking agent off the calibration patch area on the drum 222.

FIG. 7 illustrates the photoconductor drum 222 rotating through a third calibration rotation in a calibration process. As the drum 222 rotates past the second station, the sensor 224 again measures the amount of marking agent present in the area of the calibration patch. Any marking agent remaining on the drum 222 the third calibration rotation will be an amount that was not successfully scraped off the photoconductor drum 222 during the cleaning process.

Unlike calibration procedures of the prior art as described with respect to FIG. 4, for example, the exemplary calibration procedure described with respect to FIGS. 5, 6, and 7 provides measurements of the calibration patch area at various steps throughout the EP printing process. The multiple interrogations of the calibration patch area permit a more accurate calibration of the overall EP printing process and provide additional information useful in evaluating the effectiveness of each process within the EP printing process.

For example, the first measurement taken by sensor 224 during the first calibration rotation shown in FIG. 5 provides information as to the density of the calibration patch that was developed on the photoconductor drum 222. This measurement data can be compared to a known parameter by various means (e.g., a lookup table) to determine whether or not the imaging process portion of the EP printing process is operating correctly. The imaging process can be adjusted accordingly.

The second measurement taken by sensor 224 during the second calibration rotation shown in FIG. 6 provides information as to the density of the calibration patch after the transfer process has transferred the patch to a print medium. Printing device 102 can determine the actual amount of marking agent transferred to the print medium during the transfer process by calculating the difference between the first measurement of FIG. 5 and the second measurement of FIG. 6. Thus, the overall EP printing process is further characterized and can be adjusted accordingly to improve print quality.

The third measurement taken by sensor 224 during the third calibration rotation shown in FIG. 7 provides information regarding the effectiveness of the cleaning blade 226, as well as information that can used to track the amount of waste toner that may have accumulated in the waste hopper 227 of a photoconductor drum assembly 308. Printing device 102 can determine the actual amount of marking agent cleaned off the photoconductor drum 222 during the second calibration rotation of FIG. 6 by calculating the difference between the second measurement of FIG. 6 and the third measurement of FIG. 7.

It is noted that the exemplary calibration procedure described above with respect to FIGS. 5, 6, and 7 is implemented with the same hardware that already exists on conventional EP printing devices 102.

Exemplary Method for Calibrating a Printing Process

An example method for calibrating a printing process will now be described with primary reference to FIGS. 8, 9, 10, and 11. The method applies generally to the exemplary embodiment of system 100 discussed above with reference to FIGS. 1 and 2.

FIGS. 8, 9, 10, and 11 are flow diagrams that show an example of a general method for calibrating an electrophotographic (EP) printing process. At block 800 of FIG. 8, a calibration patch is formed on an area of an intermediate transfer element (e.g., a photoconductor drum) through an imaging process. At block 802, a sensor measures a first amount of marking agent (e.g., dry toner) present in the area of the calibration patch. At block 804, the calibration patch is transferred to a print medium through an image transfer process. At block 806, a cleaning blade is disengaged so that the calibration patch area will not be cleaned. At block 808, the sensor measures a second amount of marking agent present in the area of the calibration patch. At block 810, the cleaning blade is re-engaged and the calibration patch area is scraped by the cleaning blade. At block 812, the sensor measures a third amount of marking agent present in the area of the calibration patch.

Figure 8:
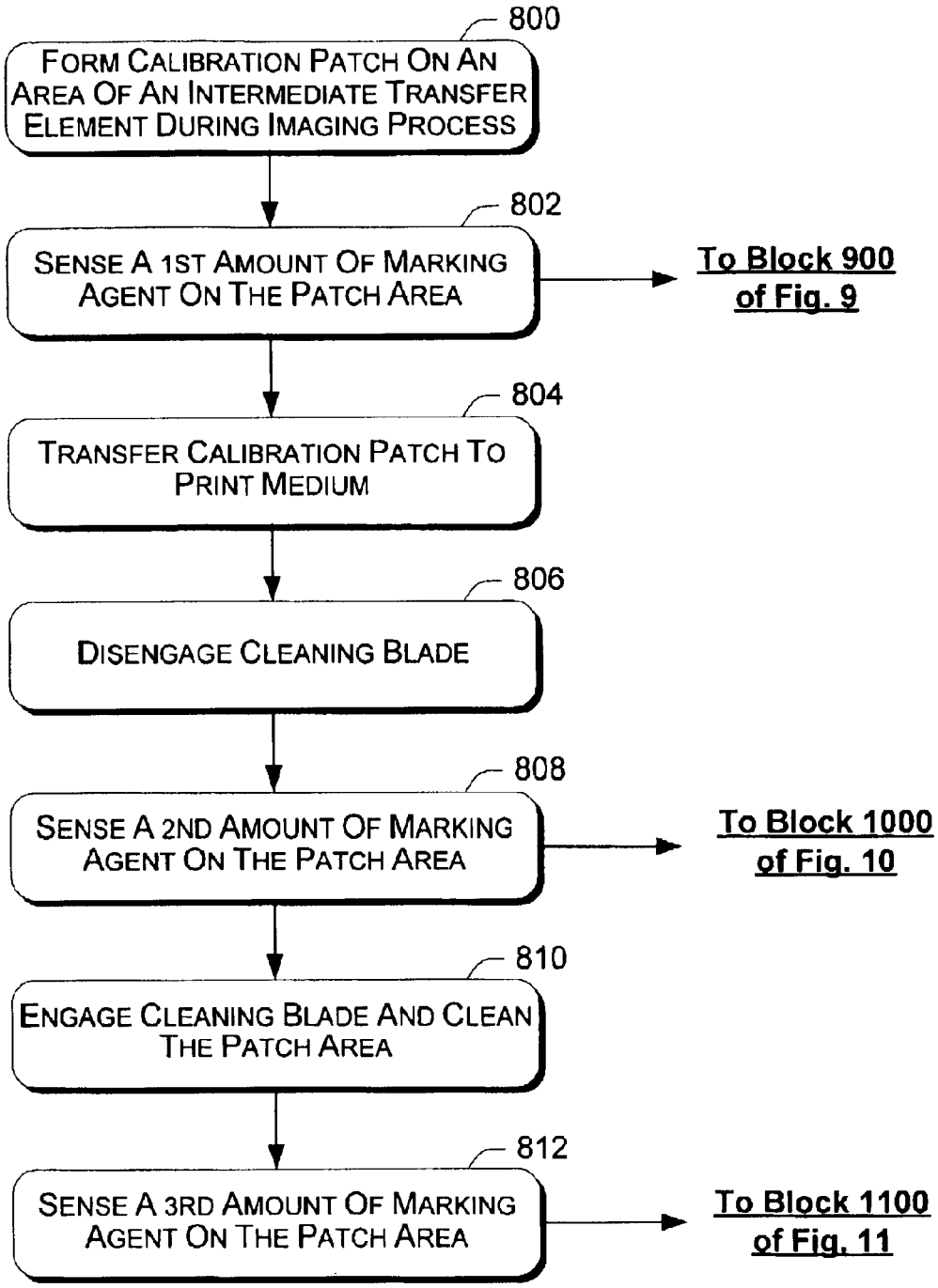
FIG. 8 is a flow diagram illustrating an example method of calibrating a printing process.
Figure 9:
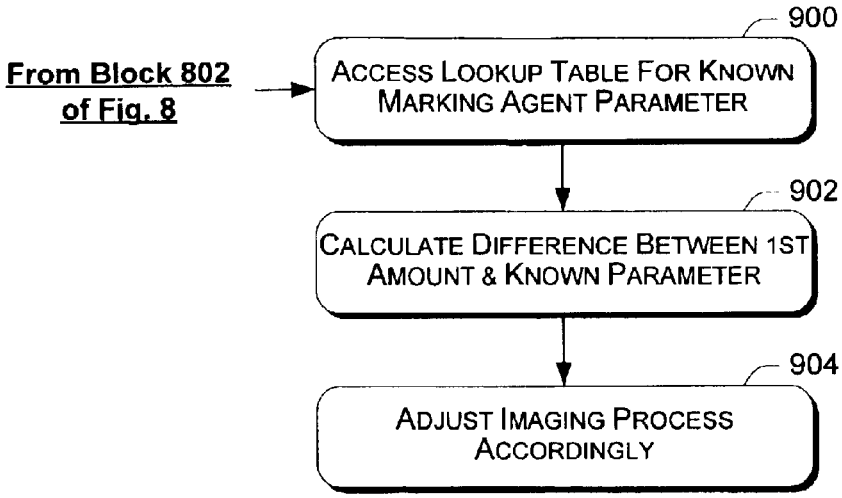
FIG. 9 is a continuation of the flow diagram of FIG. 8 illustrating an example method of calibrating a printing process.
Figure 10:
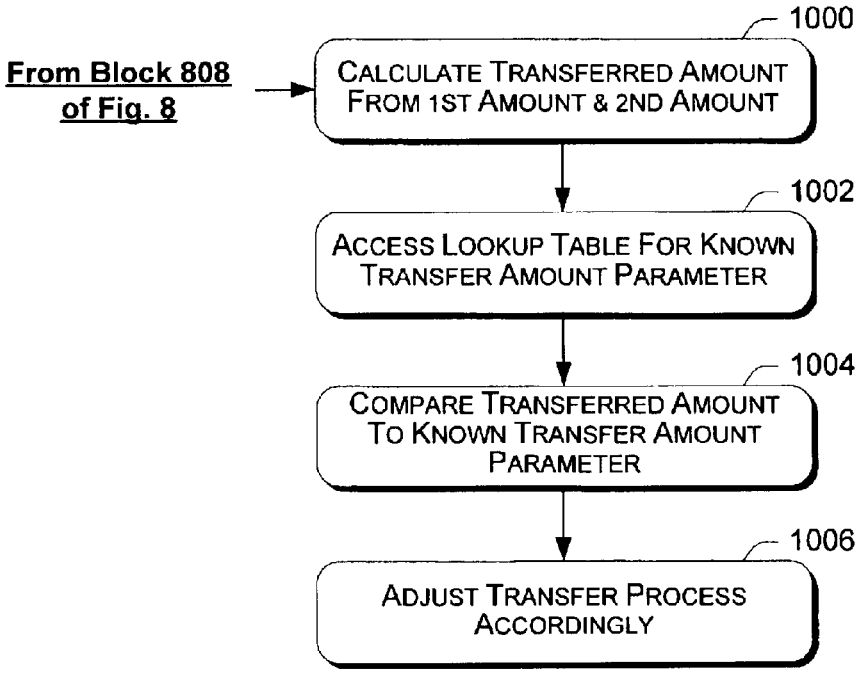
FIG. 10 is a continuation of the flow diagram of FIG. 8 illustrating an example method of calibrating a printing process.
Figure 11:
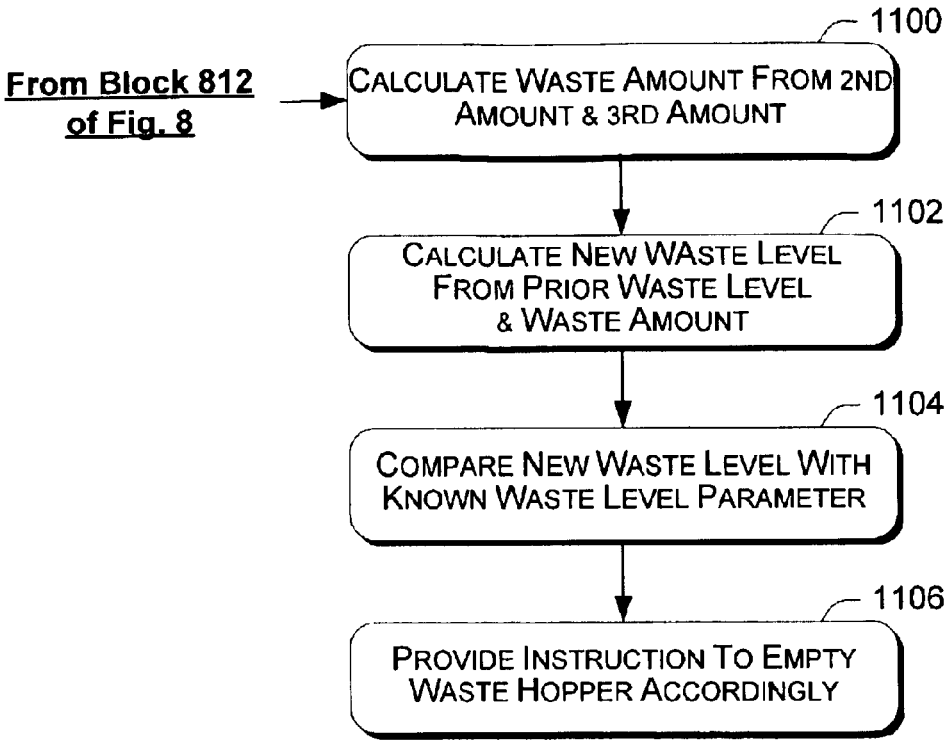
FIG. 11 is a continuation of the flow diagram of FIG. 8 illustrating an example method of calibrating a printing process.

The exemplary method continues from several blocks within FIG. 8 to FIGS. 9, 10, and 11. Thus, FIGS. 9, 10, and 11 are continuations of the exemplary method that began in FIG. 8. From block 802 of FIG. 8, the exemplary method continues to block 900 of FIG. 9. At block 900, a known marking agent parameter is accessed from a lookup table. At block 902, the difference between first amount of marking agent and the known marking agent parameter is calculated. At block 904, the imaging process portion of the overall EP printing process is adjusted according to the result of the calculation at block 902.

From block 808 of FIG. 8, the exemplary method continues to block 1000 of FIG. 10. At block 1000, an amount of marking agent transferred to a print medium is calculated based on the first amount of marking agent and the second amount of marking agent. At block 1002, a known transfer amount parameter is accessed from a lookup table. At block 1004, the transferred amount calculated in block 1000 is compared to the known transfer amount parameter from block 1002. At block 1006, the transfer process portion of the overall EP printing process is adjusted according to the result of the comparison in block 1004.

From block 812 of FIG. 8, the exemplary method continues to block 1100 of FIG. 11. At block 1100, a waste amount of marking agent is calculated from the second amount of marking agent and the third amount of marking agent. At block 1102, a new waste level is calculated from a prior waste level and the waste amount of marking agent calculated in block 1100. At block 1104, the new waste level is compared with a known waste level parameter. At block 1106, an instruction may be generated to empty a waste hopper depending on the comparison made in 1104.

Although the description above uses language that is specific to structural features and/or methodological acts, it is to be understood that the invention defined in the appended claims is not limited to the specific features or acts described. Rather, the specific features and acts are disclosed as exemplary forms of implementing the invention.

What is claimed is:

1. A method of calibrating a printing process comprising:

forming a calibration pattern on an area of an intermediate transfer interrogating the area before and after a plurality of printing functions, wherein the interrogating comprises measuring an amount of marking agent present on the area, and a first printing function comprises transferring the calibration pattern to a print medium;

calculating a transferred amount of marking agent based on amounts of marking agent measured before and after the transferring; and calibrating a printing process based on the transferred amount of marking agent, the calibrating comprising calculating a difference between the transferred amount of marking agent and a known marking agent parameter; and based on the difference, adjusting an amount of marking agent used in the printing process.

2. A method as recited in claim 1 wherein the calculating further comprises retrieving the known marking agent parameter from a lookup table.

3. A method as recited in claim 1, wherein a second printing function comprises scraping a waste amount of marking agent from the area, the method further comprising calculating the waste amount of marking agent based on amounts of marking agent measured before and after the scraping.

4. A method as recited in claim 3, further comprising:

calculating a new waste level based on the waste amount of marking agent and a prior waste level; and determining from the new waste level if a waste hopper needs to be emptied.

5. A method as recited in claim 4, wherein the determining comprises comparing the new waste level to a known waste level parameter.

6. A method as recited in claim 5, wherein the comparing further comprises retrieving the known waste level parameter from a lookup table.

7. A computer-readable medium comprising computer executable instructions configured to cause a computer to perform the method of claim 1.

8. A method for calibrating a printing process comprising:

forming a calibration patch on an area of an intermediate transfer element;

sensing a first amount of marking agent on the area;

transferring the calibration patch to a print medium;

sensing a second amount of marking agent on the area; and based on the first amount and the second amount, calculating a third amount of marking agent.

9. A method as recited in claim 8, wherein the third amount is an amount of marking agent transferred to the print medium, the method further comprising:

based on the third amount, calibrating a printing process.

10. A method as recited in claim 9, wherein the calibrating further comprises:

comparing the third amount to a known marking agent parameter; and based on the comparing, increasing or decreasing an amount of marking agent used in the printing process.

11. A method as recited in claim 10, wherein the comparing further comprises:

locating the known marking agent parameter in a lookup table; and calculating the difference between the third amount and the known marking agent parameter.

12. A method as recited in claim 8, wherein the sensing comprises measuring reflectivity of the intermediate transfer mechanism at the area.

13. A method as recited in claim 8, wherein the intermediate transfer element is selected from a group of elements comprising:

a photoconductor drum; and an intermediate transfer belt.

14. A method as recited in claim 8, wherein the marking agent is dry toner.

15. A method as recited in claim 8, further comprising:

cleaning the area; and sensing a fourth amount of marking agent on the area.

16. A method as recited in claim 15, further comprising calculating a fifth amount of marking agent based on the fourth amount and the second amount.

17. A method as recited in claim 16, further comprising:

calculating a new waste level from the fifth amount and a current waste level; and based on the new waste level, determining if a waste hopper needs emptying.

18. A method as recited in claim 17, wherein the determining comprises comparing the new waste level to a known waste level parameter.

19. A method as recited in claim 15, wherein the cleaning comprises scraping the area with a cleaning blade.

20. A computer-readable medium comprising computer executable instructions configured to cause a computer to perform the method of claim 8.

21. A method of calibrating a printing process comprising:

during a first rotation of an image transfer element, developing a calibration patch on an area of the image transfer sensing a first amount of marking agent on the area; and transferring the calibration patch to a print medium;

during a second rotation of the image transfer element, sensing a second amount of marking agent on the area; and based on the first amount and the second amount, calculating a transferred amount of marking agent.

22. A method as recited in claim 21, further comprising:

during a third rotation of the image transfer element, sensing a third amount of marking agent on the area; and based on the second amount and the third amount, calculating a waste amount of marking agent.

23. A computer-readable medium comprising computer executable instructions configured to cause a computer to perform the method of claim 21.

* * * * *

UNITED STATES PATENT AND TRADEMARK OFFICE

CERTIFICATE OF CORRECTION

PATENT NO. : 6,766,122 B2
APPLICATION NO. : 10/281613
DATED : July 20, 2004
INVENTOR(S) : Quintin T. Phillips et al.

It is certified that error appears in the above-identified patent and that said Letters Patent is hereby corrected as shown below:

IN THE CLAIMS

Column 8, Claim 1, line 17, after “transfer” insert --element;--

Column 10, Claim 21, line 14, after “transfer” insert --element;--

Signed and Sealed this

Second Day of October, 2007

JON W. DUDAS
*Director of the United States Patent and Trademark Office*